US005451044A

United States Patent [19]

Nakayama

[11] Patent Number: 5,451,044

[45] Date of Patent: Sep. 19, 1995

[54] SHEET RECEIVING AND STACKING APPARATUS

[75] Inventor: Koji Nakayama, Ushiku, Japan

[73] Assignee: Riso Kagaku Corporation, Tokyo, Japan

[21] Appl. No.: 231,422

[22] Filed: Apr. 22, 1994

[30] Foreign Application Priority Data

May 17, 1993 [JP] Japan ..... 5-114877

[51] Int. Cl.[6] ..... B65H 29/34

[52] U.S. Cl. ..... 271/189; 271/209; 271/220

[58] Field of Search ..... 271/189, 207, 209, 220, 271/223

[56] References Cited

U.S. PATENT DOCUMENTS

| | | | |
|---|---|---|---|
| 3,420,519 | 1/1969 | Edwards | 271/189 |
| 4,083,552 | 4/1978 | Sioman | 271/189 |
| 4,469,321 | 9/1984 | Geschwindner | 271/189 X |
| 4,938,657 | 7/1990 | Benson et al. | 271/209 X |
| 4,997,176 | 3/1991 | Hain | 271/189 X |

FOREIGN PATENT DOCUMENTS

| | | | |
|---|---|---|---|
| 2457239 | 1/1981 | France | 271/189 |
| 81049 | 5/1982 | Japan | 271/207 |
| 81050 | 5/1982 | Japan | 271/207 |
| 211265 | 9/1986 | Japan | 271/209 |
| 69449 | 3/1989 | Japan | 271/220 |
| 143865 | 6/1991 | Japan | 271/209 |
| 2037712 | 7/1980 | United Kingdom | 271/189 |
| 1161447 | 6/1985 | U.S.S.R. | 271/209 |

*Primary Examiner*—H. Grant Skaggs
*Attorney, Agent, or Firm*—Kanesaka & Takeuchi

[57] ABSTRACT

A sheet receiving and stacking apparatus is formed of a base table with a stacking section for stacking a rectangular sheet, and guide members for receiving the rectangular sheet and for guiding the rectangular sheet to the stacking section of the base table. The guide members have at least one movable member which protrudes out on the stacking section side of the base table. The movable member receives the side edge of the rectangular sheet floating downwardly, retreats to the outside of the stacking section with the weight of the rectangular sheet, and is movable to protrude again towards the stacking section side when freed from the weight of the rectangular sheet.

10 Claims, 4 Drawing Sheets

SHEET RECEIVING AND STACKING APPARATUS

BACKGROUND OF THE INVENTION

1. Field of the Invention

The present invention relates to a sheet receiving and stacking apparatus for receiving and stacking plastics sheets and other kinds of paper which are rectangular sheets and, more particularly, is applicable to a delivery apparatus in an image forming apparatus such as a printing apparatus.

2. Description of the Related Art

Generally, as a sheet receiving and stacking apparatus for receiving and stacking rectangular printed sheets, a delivery apparatus provided at the discharge section of a printing apparatus has been known. This type of delivery apparatus 1, as shown in FIG. 1, commonly has a base table 6 for receiving printed paper 3, a pair of parallel side boards 4, 4 provided generally vertically on both sides of the base table 6 in a direction in which the paper 3 is received, and an end plate 5 provided at the forward end of the base table 6 in the direction of reception of the paper 3. Both side edges of the paper 3 ejected from the printing section of the printing apparatus 2 are received between two side boards 4, 4 which are disposed parallelly, generally equal to the width of the paper 3. The leading edge of the ejected sheet 3 strikes the end plate 5 located at front and floats down to the stack section on the base table 6.

In such a delivery apparatus 1, in the case of printing of a low printing rate on the paper 3, that is, in the case of a small amount of printing ink to be transferred to the paper 3, the paper 3 is discharged out of the printing apparatus 2 without changing its flat form; therefore there will occur no problem about the stacking of the paper 3 in the delivery apparatus 1. However, in the case of a high printing rate, for example when a large amount of ink has been transferred to the paper 3 as in solid printing, the upper surface of the paper 3 to which the ink has been transferred extends largely, curling largely downwardly into an upwardly swollen form on the whole. The paper 3 discharged from the printing apparatus, therefore, will be stacked in a disorderly fashion on the base table.

To solve this problem, there has been a printing apparatus 7 of known art that, as shown in FIG. 2, is provided with an auxiliary paper discharge member 8 at the inlet of the delivery apparatus 10 mounted in the paper delivery section. This auxiliary member 8 holds upwardly both side edges of the paper 9 in a direction of travel of the paper 9 discharged from the printing apparatus 7, so that the paper 9 is bent into a form of U letter in the delivery state to thereby provide the paper 9 with stiffness and thereby prevent the paper 9 from being largely curled with the effect of ink and stacked on the delivery apparatus 10 in a disorderly fashion.

Another apparatus which curves the paper into a U-letter form has been disclosed in Japanese Utility Model Laid-Open No. Hei 5-10367. This apparatus has a pair of side plates so disposed as to face each other at a spacing on the delivery table, a pair of guide members provided on the pair of side plates so disposed as to face each other and protrusible on the delivery table, and guide members driving means for driving the guide members by turning the guide members in synchronism with the delivery of the image forming apparatus.

PROBLEMS TO BE SOLVED BY THE INVENTION

The conventional delivery apparatus described above, however, has such a problem that both side edges of the paper 9 are partly held upwardly when the aforesaid auxiliary paper discharge member 8 is employed, but other portion of the paper 9 apart from the auxiliary paper discharge member 8 becomes free; the paper 9, therefore, is still affected by the ink to curl largely with the ink, resulting in unevenly stacked paper.

In the delivery apparatus in which the guide members provided on the side plates are forced to move in and out by the guide member driving member in synchronization with the delivery of paper from the image forming apparatus, it is difficult to control the guide member driving means in accordance with the hardness of the paper, or a difference in the stiffness of the paper, which is determined by a difference in thickness and weight which depend upon the kind of the paper. Besides, the construction of the delivery apparatus required for mounting the guide member driving means will become complicated, which will cause a trouble to occur and will raise manufacturing cost.

SUMMARY OF THE INVENTION

It is, therefore, an object of the present invention to provide a sheet receiving and stacking apparatus of simple constitution for stacking paper which is able to maintain a uniform stack of paper that has been subjected even to curling with the effect of ink.

To solve the above-described problems, the invention according to a first aspect provides a sheet receiving and stacking apparatus for stacking paper, which has a base table provided with a stacking section for stacking rectangular sheets, and guide members for receiving the rectangular sheets and guiding the rectangular sheets to the stacking section of the base table, wherein the guide members have at least one movable member which protrudes out on the stacking section side of the base table; the movable member receives the side edges of the rectangular sheets dropping, and withdraws outwardly from the stacking section with the weight of the rectangular sheets; and also the movable member is so constituted as to be moved outwardly again on the stacking section side when released from the weight of the rectangular sheets.

According to a second aspect of the present invention, the guide members defined in the first aspect of the present invention are provided in a pair, which are disposed substantially in parallel at a spacing on the base table so that both side edges of the rectangular sheet will be received.

A third aspect of the present invention uses a plurality of movable members, each of which is defined in the first aspect of the present invention.

According to a fourth aspect of the present invention, the forward ends of the movable members, which are protruding on the stacking section side in the first aspect of the present invention, are inclined downwardly towards the stacking section.

According to a fifth aspect of the present invention, the movable member is rotatably provided about its support shaft so that the forward end of the movable member, which protrudes on the stacking section side in the first aspect of the present invention, can approach the stacking section; and a turning moment on the portion of the stacking section which is outside of the aforesaid shaft and turns about the shaft as a support shaft is greater than the portion protruding to the stacking section from the shaft.

According to a sixth aspect of the present invention, the movable members defined in the first aspect of the present invention are so constituted as to withdraw outwardly from the stacking section when the rectangular sheets are taken out.

According to a seventh aspect of the present invention, at least the stacking section of the base table defined in the first aspect of the present invention is curved to a recess form in the surface perpendicular to the direction of discharge of the rectangular sheet from the image forming apparatus.

According to an eighth aspect of the present invention, the movable members defined in the first aspect of the present invention are designed to be selectively fixed in a position to which the movable members have been withdrawn outwardly from the stacking section.

According to a ninth aspect of the present invention, the guide members defined in the seventh aspect of the present invention are arranged parallelly relative to the direction of discharge of paper to be discharged from the image forming apparatus.

According to a tenth aspect of the present invention, in the sheet receiving and stacking apparatus which has the base table provided with the stacking section for stacking the rectangular sheets and the guide members for receiving the rectangular sheets and then guiding the rectangular sheets at the stacking section of the base table, the guide members include the following members (1) and (2).

(1) Movable members movable between the position in which the movable members protrude on the stacking section side of the base table which receive the side edges of the rectangular sheets and the outward position of the stacking section of the base table.

(2) Elastic members for setting the movable members in the position in which the movable members not in contact with the rectangular sheets are moved to protrude out on the stacking section side of the base table, and for allowing the movable members loaded with the rectangular sheets to move to the outward position of the stacking section of the base table.

Rectangular sheets printed at the image forming apparatus are discharged onto the stacking section of the base table. The rectangular sheets are then received by the guide members, where their both side edges are held in contact with the movable members of the guide members, thus bending with its own weight to a downwardly curved U-letter form. The movable members move away, with the weight of the rectangular sheets, towards the outside of the stacking section, and the rectangular sheets drop onto the stacking section where the paper will be stacked. The movable members freed from the weight of the rectangular sheet are reset to original positions where they protrude on the stacking section side.

DESCRIPTION OF THE PREFERRED EMBODIMENTS

Hereinafter preferred embodiments of a sheet receiving and stacking apparatus according to the present invention will be described with reference to the accompanying drawings.

Figure 1:
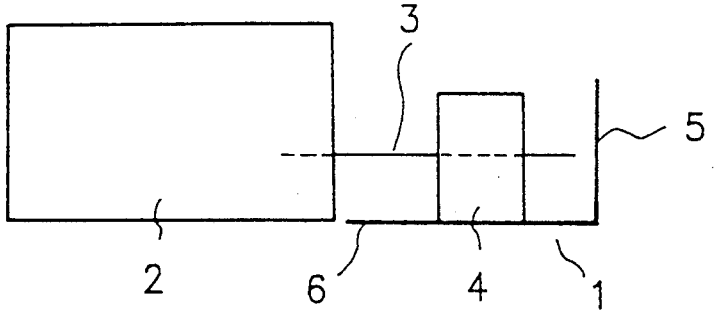
FIG. 1 is a side view showing the constitution of a conventional printing apparatus and delivery apparatus.
Figure 2:
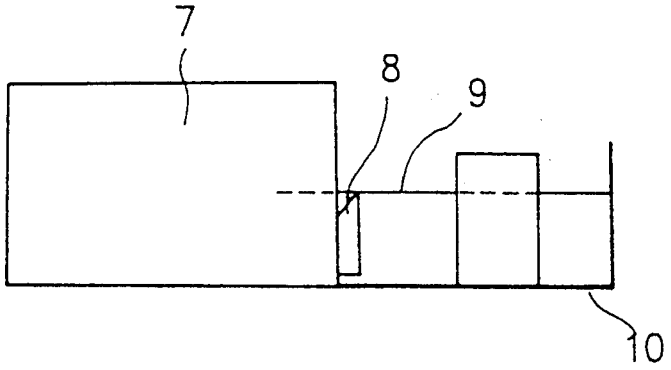
FIG. 2 is a side view showing the constitution of a conventional printing apparatus and delivery apparatus.
Figure 3:
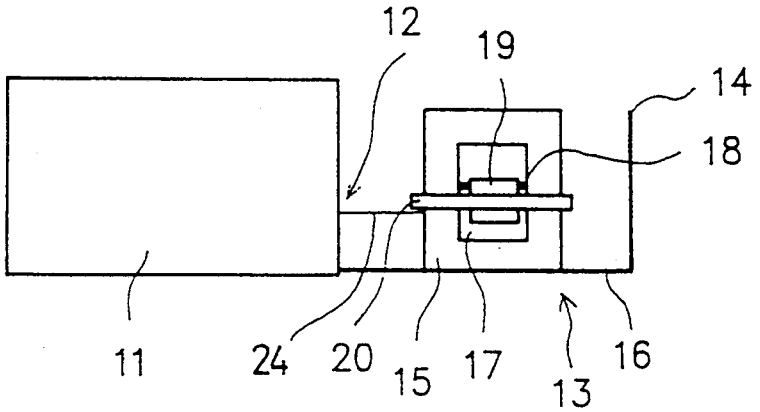
FIG. 3 is a side view of a first embodiment of the present invention.
Figure 4:
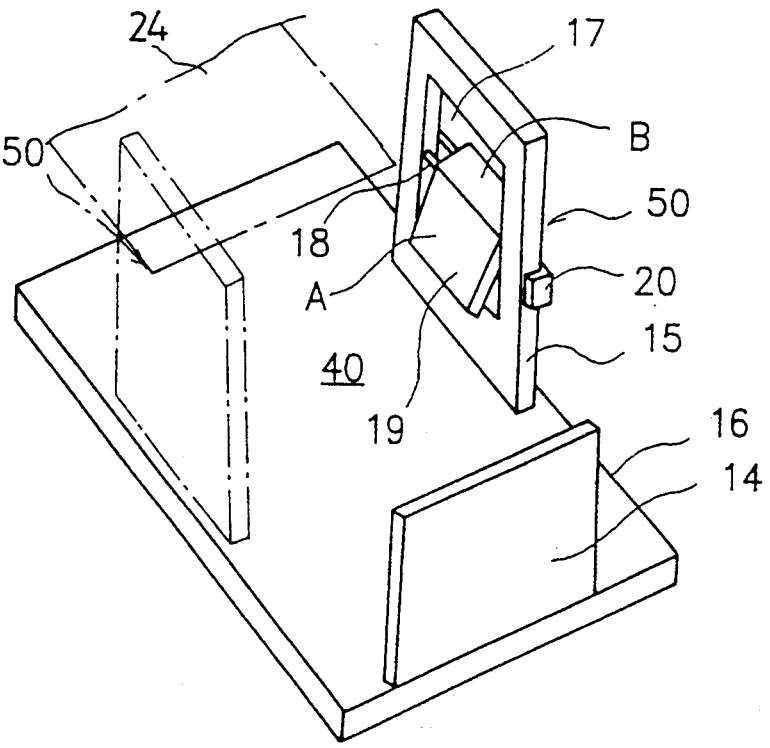
FIG. 4 is an enlarged perspective view of a major portion of the first embodiment of the present invention.
Figure 5:
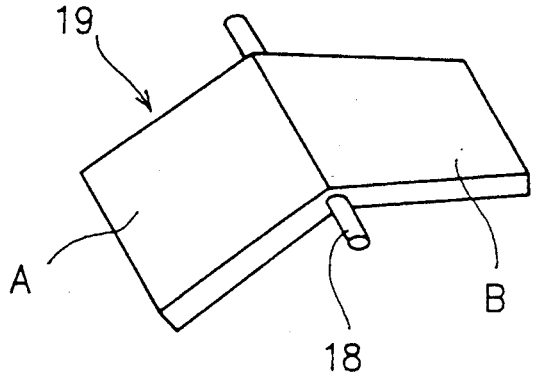
FIG. 5 is a perspective view of movable members in the first embodiment of the present invention.

FIG. 3 is a side view showing one embodiment of the printed sheet stacking apparatus according to the present invention; FIG. 4 is a perspective view showing one guide means, partly omitted, in the sheet receiving and stacking apparatus of the embodiment; and FIG. 5 is a perspective view showing the constitution of a major portion of the same embodiment.

To explain the present embodiment by referring to the drawings, a delivery apparatus 13 which is an apparatus for receiving and stacking paper is connected to the paper discharge side 12 of a mimeograph machine 11 which is image forming means. The delivery apparatus 13 has an end plate 14 nearly perpendicularly on the base table and movably towards the mimeograph machine 11, for stopping the leading edges of ejected sheets. Also provided nearly at right angles with the end plate 14 are a pair of side plates 15, which are movable towards the inside of the base table 16 in accordance with the size of the paper. The side plates 15 constitute a body of guide members 50 for guiding the paper to the stacking section on the base table 16. The sheet stacking section 40 is defined on the base table by these side plates 15, 15 and the end plate 14.

The side plate 15 is provided with a window 17; and on a shaft 18 disposed in the inside surface is rotatably installed a movable member 19 of the guide member 50. The movable member 19 is composed of plate-like plate portions A and B mounted on the shaft 18 which serves as a base shaft. The surfaces of these plate portions A and B meet at an angle of 135°. The turning moment on the plate portion B turning on the shaft 18 as the support shaft is greater than that of the plate portion A, so that when the side edge portion of the paper rides on the plate portion A, the movable plate becomes unbalanced, easily turning to the plate portion A side. The plate portion A and the plate portion B may be formed in one unit or may be constituted of a plurality of parts.

On the outside surface of the side plate 15 is provided a seat 20 for restraining the plate portion B from further turning, thus maintaining the plate portion B level while protruding the plate portion A to the inside of the side plate 15.

According to the above-described constitution, a paper 24 ejected from the mimeograph machine 11 is supported at both side edges on the plate portions A of the movable members 19, bending downwardly to a U-letter form to thereby prevent curling of the paper with the ink. Since the movable member 19 is turned with the weight of the paper 24, the sheet comes off the movable member 19, floating downwardly to the stacking section 40. With repetition of this operation, the paper 24 is stacked evenly on the stacking section 40 of the base table 16.

Figure 6:
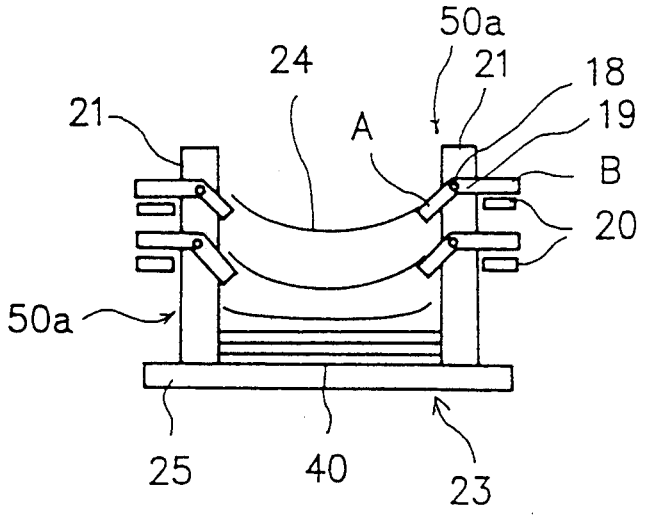
FIG. 6 is a sectional view of a second embodiment of the present invention.

Next, the constitution and operation of another embodiment of the printed sheet stacking apparatus having a plurality of movable members will be outlined by referring to FIG. 6.

As shown in FIG. 6, a pair of side plates 21, 21 parallelly disposed in opposite positions are provided each with two movable members 19, upper and lower, which are arranged at a specific spacing. The two movable members 19 provided on each side plate, although not illustrated, are arranged in two rows parallelly; that is, four movable members 19 are provided on each side plate. Each movable member 19 mounted on the pair of side plates which are oppositely arranged is provided in the same, corresponding position.

When both edges of the printed sheet ejected from the mimeograph machine 11 come on the plate portions A of the movable members 19, the central portion of the paper 24 bends downwardly into a U-letter form. The paper 24 thus bent into the U-letter form has stiffness, and therefore it is possible to prevent curling with ink likely to occur in the case of solid printing. When the paper 24 has first come on the plate portion A of the upper movable member 19, the movable member 19 is pushed to turn downwardly with the weight of the paper 24 on the shaft 18 of the movable member 19, allowing the paper 24 to float downwardly onto the plate portion A of the lower movable member 19. With the repetition of this operation, the sheet is stacked clean on the base table 25 while maintaining the U-letter form.

Figure 7:
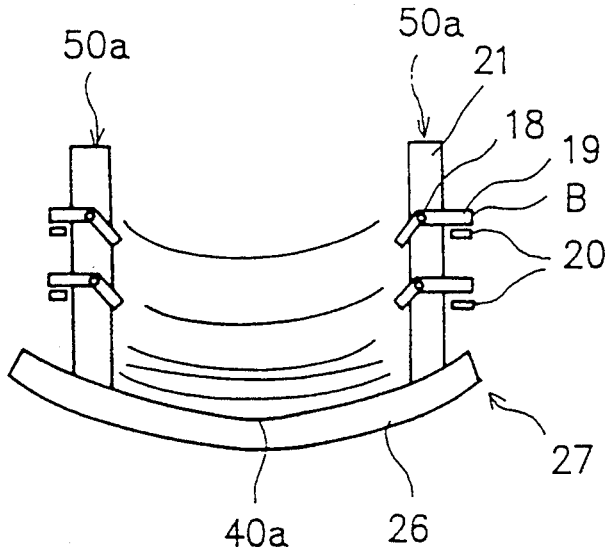
FIG. 7 is a sectional view of a third embodiment of the present invention.

FIG. 7 shows another embodiment of the sheet receiving and stacking apparatus with the base table of FIG. 6 bent in the U-letter form.

In the following explanation, the same parts and portions as those in FIG. 6 are designated by the same numerals. The base table 26 is bent in a downwardly curved form; the paper 24 supported in a downwardly curved form by the movable members 19 is stacked as-curved in the downwardly curved stacking section 40*a*, and therefore the paper 24 ejected onto the base table will be stacked further orderly.

Figure 8:
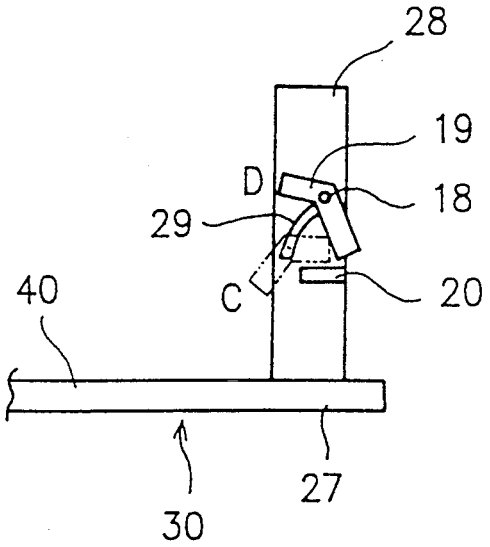
FIG. 8 is a sectional view of a fourth embodiment of the present invention.

FIG. 8 is a sectional view of another embodiment in which the movable members are withdrawn from above the stacking section 40.

Hereinafter operation of only one movable member mounted on one side plate will be described, which will be similarly applicable to a plurality of movable members.

On the side plate 28 mounted generally perpendicularly on the base table 27 is provided the movable member 19 explained in FIG. 5; and the plate portion B is held by the base seat 20 so that the plate portion A of the movable member 19 is maintained protruding on the inside of the side plate 28. The shaft 18 is movable from a specific position C to a retreat position D along a curved guide rail 29 provided on the side plate 28. The protruding portion of the movable member 19 which interferes when unloading of the printed sheets from the base table 27 is moved along the guide 29 together with the shaft 18 from the position C to the position D by the printed sheets held up by hand, fully retreating the protruding portion of the movable member 19 from above the stacking section 40. The printed sheets stacked evenly on the base table 27 can be taken out from the delivery apparatus.

Furthermore, in FIG. 6, the base seat 20 may be designed to be movable from the illustrated position to the upper specific position, where the base seat 20 can be fixed. When the base seat 20 is fixed in the upper position, the plate portion B of the movable member 19 is raised, retreating the plate portion A fully from above the stacking section 40 and ensuring the fixing of the plate portion A in a position inside of the side plate 21. Thus the paper 24 stacked on the stacking section 40 of the base table 25 can easily be taken out.

In the explanation given above, a particular embodiment has been referred to, but the movable members are not necessarily required to be mounted directly on the guide members, and also not required to be mechanically connected with the guide members if constructed movable from the guide members towards the paper stacking section side.

For the number and arrangement of the movable members, plural rows and lines can be selected; when, however, the apparatus has a pair of parallel side plates set nearly vertically on both sides of the base table, it is desirable that the same number of movable members be provided in the same positions as the side plates. Also it is desirable that the side plates be designed to be movable towards the center of the base table as in the case of a prior art. Furthermore, it is desired that the base table or the paper stacking section be curved in the U-letter form.

Each of the embodiments described above pertains to the delivery apparatus of a printing machine, but it is to be understood that the use of the present invention is not limited to the delivery apparatus of the printing machine, and the delivery apparatus may be easily selected by those skilled in the art if its object is to maintain an even stack of plastics films and other kinds of sheets.

According to the present invention, as heretofore described, the movable members which are rotatable are able to give rigidity to even such solid-printed paper that is likely to curl due to absorption of much ink, by bending the paper to a form of U letter; and therefore printed sheets ejected from the printing machine can be stacked evenly on the base table.

In each embodiment described above, the movable member of the guide member is moved outwardly of the stacking section with the weight of the rectangular sheet, and after the drop of the rectangular sheet to the stacking section, the movable member turns with its own weight back to the stacking section side. However, the movable member may be set in a specific position so that, in this position, the movable member will be able to move between the stacking section side and the outside of the stacking section, and will be pushed with an elastic member such as a spring towards the stacking section side to receive the rectangular sheet. And the movable member is constituted such that the weight of the rectangular sheet, when added to the movable member, overcomes the force of the elastic member such as the spring to move the movable member to the outside of the stacking section, so that after the rectangular sheet floats downwardly to the stacking section, the movable member can be reset by the force of the elastic member to the stacking section side.

What is claimed is:

1. A sheet receiving and stacking apparatus, comprising:

a base table with a stacking section for stacking a sheet with parallel side edges; and a pair of guide members situated on the base table to be substantially parallel to each other with a space for receiving the side edges of the sheet and guiding said sheet onto the stacking section of the base table, each guide member having at least one movable member protruding to a side of the stacking section, said movable member having a forward end inclined downwardly toward the stacking section, said movable members receiving the side edges of the sheet floating downwardly thereto, retreating outwardly from the side of the stacking section with a weight of the sheet and moving to protrude again toward the side of the stacking section when the sheet falls from the movable members.

2. A sheet receiving and stacking apparatus as claimed in claim 1, wherein said guide members are provided with a plurality of movable members.

3. A sheet receiving and stacking apparatus as claimed in claim 1, wherein said movable members are axially rotatably mounted so that the forward ends of said movable members protruding on said stacking section can approach said stacking section, and a portion of said movable member disposed outwardly from a shaft relative to said stacking section requires a greater turning moment than a portion protruding from said shaft into said stacking section.

4. A sheet receiving and stacking apparatus as claimed in claim 1, wherein said movable members are withdrawable towards the outside of said stacking section when said sheets are taken out.

5. A sheet receiving and stacking apparatus as claimed in claim 1, wherein at least said stacking section of said base table is bent to a downwardly curved form in a plane perpendicular to the direction of discharge of said sheet from an image forming apparatus.

6. A sheet receiving and stacking apparatus as claimed in claim 5, wherein said guide members are arranged in parallel with the direction of discharge of the sheet ejected from said image forming apparatus.

7. A sheet receiving and stacking apparatus as claimed in claim 1, wherein each guide member includes means for selectively locating the movable member outside the stacking section.

8. A sheet receiving and stacking apparatus, comprising:

a base table with a stacking section for stacking a sheet with parallel side edges; and a pair of guide members for receiving the side edges of the sheet and guiding said sheet onto the stacking section of the base table, said guide members including side plates situated on the base table substantially parallel to each other with a space therebetween and having windows therein, and movable members with shafts, each movable member being situated in the window and rotatably attached to the side plate by the shafts, each movable member having an outer plate portion extending in a direction away from the base table and an inner plate portion inclined relative to the outer plate portion and protruding downwardly toward the stacking section, said movable members receiving the side edges of the sheet floating downwardly thereto, retreating outwardly from a side of the stacking section by a weight of the sheet and moving to protrude again toward the side of the stacking section when the sheet falls from the movable members, said outer plate portion having a turning moment greater than that of the inner plate portion so that when the sheet is disposed on the inner plate portion, the movable member can rotate easily around the shaft by the weight of the sheet.

9. A sheet receiving and stacking apparatus as claimed in claim 8, wherein said guide member further includes a seat situated adjacent to the window, said seat supporting the outer plate portion so that the inner plate portion slightly protrudes to the side of the stacking section.

10. A sheet receiving and stacking apparatus as claimed in claim 9, wherein said movable members are disposed in one side plate vertically spaced apart from each other.

* * * * *